United States Patent [19]

Spector

[11] Patent Number: 5,035,426

[45] Date of Patent: Jul. 30, 1991

[54] PNEUMATIC PLAY BALL

[76] Inventor: Donald Spector, 380 Mountain Rd., Union City, N.J. 07087

[21] Appl. No.: 622,960

[22] Filed: Dec. 6, 1990

Related U.S. Application Data

[63] Continuation-in-part of Ser. No. 345,405, May 1, 1989, which is a continuation-in-part of Ser. No. 205,477, Jun. 13, 1988, Pat. No. 4,834,382.

[51] Int. Cl.[5] ..... A63B 41/00

[52] U.S. Cl. ..... 273/65 EG; 273/DIG. 20; 273/65 A

[58] Field of Search ..... 273/DIG. 20, 58 B, 58 BA, 273/65 R, 65 B, 65 E, 65 ED, 65 EB, 65 EC, 65 EE, 65 EF, 65 F, 65 A, 65 C, 65 D

[56] References Cited

U.S. PATENT DOCUMENTS

| | | | |
|---|---|---|---|
| 717,229 | 12/1902 | Lott | 273/65 B |
| 4,758,199 | 7/1988 | Tillotson | 446/225 |
| 4,834,382 | 5/1989 | Spector | 273/65 EG |

*Primary Examiner*—George J. Marlo
*Attorney, Agent, or Firm*—Michael Ebert

[57] ABSTRACT

A pneumatic play ball that includes an outer casing of non-stretchable material having a slit therein, the configuration of the casing depending on the nature of the ball. The casing encases a balloon of stretchable material which when unconfined is capable of being inflated to assume a generally globular form, the balloon having an air-passage stem. In its uninflated state, the balloon is inserted into the casing through an open port created by dilating the slit, the stem then projecting out of the port. After the confined balloon is inflated by blowing air through its stem to cause the balloon to conform to the inner surface of the casing and to assume the same configuration, the stem is knotted to seal the balloon. The knotted stem is pushed under the slit which, because the casing is subjected to tension by the inflated balloon confined therein, causes the slit to recover its undilated, substantially closed state whereby no portion of the encased balloon can be extruded from the casing when the ball bounces.

6 Claims, 2 Drawing Sheets

PNEUMATIC PLAY BALL

RELATED APPLICATION

This application is a continuation-in-part of my copending application Ser. No. 345,405, filed May 1, 1989, entitled Pneumatic Bolster, which in turn is a continuation-in-part of my patent application Ser. No. 205,477, filed June 13, 1988, entitled "Inflatable Play Ball" (now U.S. Pat. No. 4,834,382), the entire disclosures of these earlier applications being incorporated herein by reference.

BACKGROUND OF INVENTION

1. Field of Invention

This invention relates generally to pneumatic play balls, and more particularly to a light weight play ball whose inner inflatable bladder is an ordinary rubber balloon, yet the ball is of exceptional strength so that it may be subjected to rough handling.

2. Status of Prior Art

A standard football is of oval shape and is made of an inflatable, high strength inner bladder and an outer casing formed of heavy leather, rubber or flexible plastic material. The bladder is provided with a valve so that it can be inflated with air, the valve automatically closing to retain the air in the bladder. Made in a similar fashion are spherical soccer balls, volley balls and basketballs. In these standard balls, the bladder is molded to assume, when inflated, the same shape as the outer casing.

In the process of play, standard sports play balls of the pneumatic type are tossed, kicked and bounced, the balls being capable of withstanding very rough handling. While such balls are not regarded by adults as unduly heavy, they represent an intolerable load to a young child. Moreover, a standard inflatable athletic ball tends to produce a "hand sting." This effect arises when the ball which has a hard casing is caught by the bare hands while moving at high velocity.

While small children are attracted to conventional athletic balls and enjoy watching adults play soccer, football and other ball games, in the hands of a small child these athletic balls are heavy and dangerous, especially in indoor play. The standard inflated athletic ball has a relatively large diameter and a smooth, hard outer casing which makes it very difficult for a small child to grasp, throw and catch.

The toy and game industry has long recognized the need for a lighter, softer and potentially less dangerous ball for young children. Thus, balls in various shapes and sizes are not commercially available which are molded of polyurethane foam material and other lightweight compressible plastics. While such balls are safe in the hands of pre-school children and will inflict no harm even if the ball is hurled toward the body of another child, they fail in many respects to satisfy the typical child's desire for a ball that looks like a real athletic ball of the type used by adults, that is bouncy and is not an unconvincing substitute for a regulation ball.

Thus the soft play balls described in the Wexler U.S. Pat. No. 4,738,450 are provided with an outer casing an an inner core of shredded fibrous material. But such balls, while they look like a standard athletic ball, lack pneumatic characteristics and do not bounce.

Another practical drawback of a conventional inflatable play ball is that it cannot readily be collapsed, flattened out and folded to form a compact package. If, therefore, one wishes to take a conventional play ball to a park or beach for use by children, one must carry the ball in its inflated condition. This presents a problem if the parents accompanying the children are already loaded with folding chairs, picnic baskets and other articles appropriate to the occasion.

My prior U.S. Pat. No. 4,834,382 (Spector) discloses a pneumatic play ball that has the configuration and appearance of a standard pneumatic athletic ball, such as a regulation basketball. Yet the patented ball is much lighter and therefore in the hands of young children is safer to play with, especially in indoor play. Despite its light weight, the ball is exceptionally strong. And when not in use, the Spector ball may be collapsed into a highly compact form.

The Spector ball is constituted by an outer casing and an inner inflatable bladder. The outer casing is formed by contoured segments of high strength, non-stretchable fabric material stitched together to define, when the casing is fully expanded, a play ball of the desired shape and size, such as a football or soccer ball. The inner bladder is a conventional thin-skin rubber balloon whose stem initially projects through an opening in the casing which is provided with a closure.

The stem, after the balloon is inflated with air so that it conforms to the casing, is then tied into a knot to retain the air, the tied stem being pushed into the casing and being concealed by the closure. Because the balloon is fully encased, no portion thereof can be extruded from the casing when the ball is bounced and the internal pressure within the balloon is increased.

Thus when the Spector ball is assembled, no portion of the inflated balloon therein is exposed, for the balloon, including its stem, is then enclosed by the outer casing. An un-encased rubber balloon has little strength and is easily burst by applying external pressure to one region thereof, as a result of which the unpressed region is caused to stretch to its bursting point. But when the inflated balloon is confined within a non-stretchable fabric casing, even though the balloon, per se, is inherently weak, because of the casing does not permit any region of the balloon to further expand beyond its existing degree of expansion, the balloon will not burst even if a heavy adult sits on the ball or the ball is given a hard kick.

The reason the Spector ball has high bounce characteristics is that its internal air pressure is much higher than a conventional beach ball made of a non-stretchable plastic film. In the conventional beach ball, it takes little pressure to blow it up, for the plastic sphere offers little resistance to expansion until it is fully inflated, at which point since the material is non-stretchable, it cannot be further inflated. But with a stretchable rubber balloon, it takes much more air pressure to stretch the rubber from its initial state to its stretched and inflated state, as a consequence of which the internal air pressure in the Spector ball is much higher than in a conventional beach ball. The bounce characteristics of a pneumatic ball is a function of its internal air pressure. Thus in a standard tennis ball, when the internal air pressure is reduced as a result of gradual air leakage, the ball becomes "dead" and then has insufficient bounce for the game.

In the Spector ball, the opening in the casing must be large enough to permit insertion therethrough of an uninflated rubber balloon, and also to permit withdrawal from the casing of the balloon after it has been deflated by puncturing the balloon. While this makes it necessary, in order to reuse the ball, to insert therein a fresh balloon, the cost of a typical rubber balloon lies in the penny range.

The Spector patent discloses an opening in the casing and a separate closure therefor such as a zipper or Velcro fastener. Closures of these types need only add to the cost of fabricating the casing but they also have practical drawbacks. Thus a Velcro fastener necessarily protrudes somewhat above the surface of the casing, while in the case of a zipper, its pull tag will dangle from the casing.

The following patents disclose pneumatic articles which make use of rubber balloons and are therefore of prior art interest: U.S. Pat. Nos. Hendershott, 4,917,382; Murphy, 1,558,200; Hendry, 1,383,115.

SUMMARY OF INVENTION

In view of the foregoing, the main object of this invention is to provide a pneumatic ball of the type disclosed in the Spector patent in which the opening in the casing for admitting therein an uninflated balloon and the closure therefor is constituted by a simple slit functioning both as an opening and a closure.

A significant advantage of the invention is that the slit can be formed in the casing fabric at low cost in a manner similar to the formation of a buttonhole in fabric apparel. Another advantage of a slit over an opening and a separate closure therefor is that the slit does not protrude from the casing.

More particularly, an object of this invention is to provide a slit in the fabric casing of a pneumatic ball of the above type whose borders are reinforced whereby the slit can survive prolonged use.

Briefly stated, these objects are attained in a pneumatic play ball that includes an outer casing of non-stretchable material having a slit therein, the configuration of the casing depending on the nature of the ball. The casing encases a balloon of stretchable material which when unconfined is capable of being inflated to assume a generally globular form, the balloon having an air-passage stem. In its uniflated state, the ballon is inserted into the casing through an open port created by dilating the slit, the stem then projecting out of the port.

After the confined balloon is inflated by blowing air through its stem to cause the balloon to conform to the inner surface of the casing and to assume the same configuration, the stem is knotted to seal the balloon. The knotted stem is pushed under the slit which, because the casing is subjected to tension by the inflated balloon confined therein, causes the slit to recover its undilated, substantially closed state whereby no portion of the encased balloon can be extruded from the casing when the ball bounces.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 3:
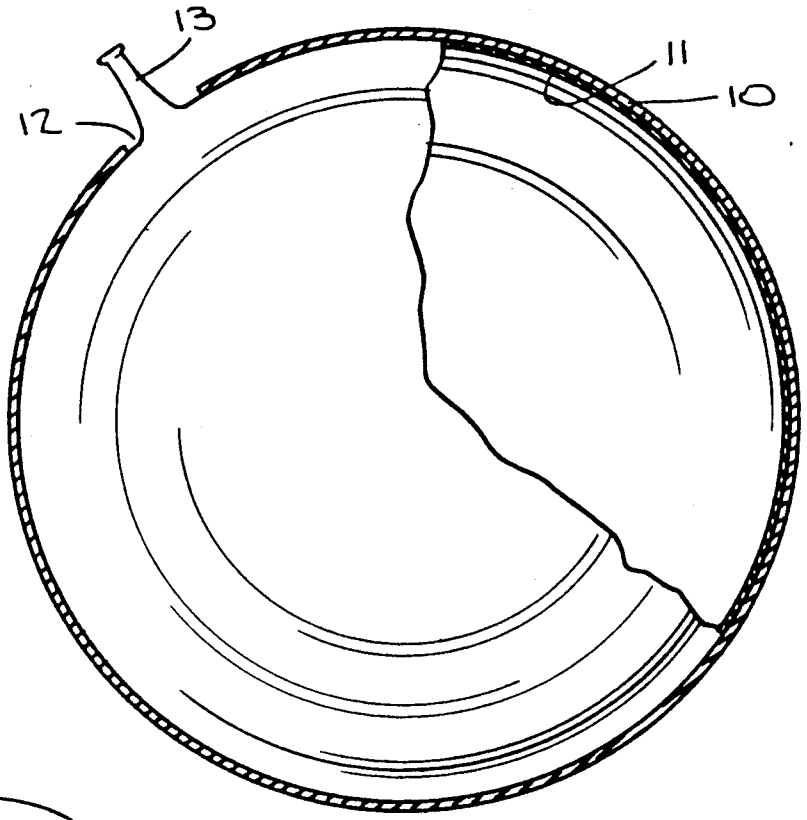
FIG. 3 shows, in section, the inflated balloon within a spherical casing.
Figure 2:
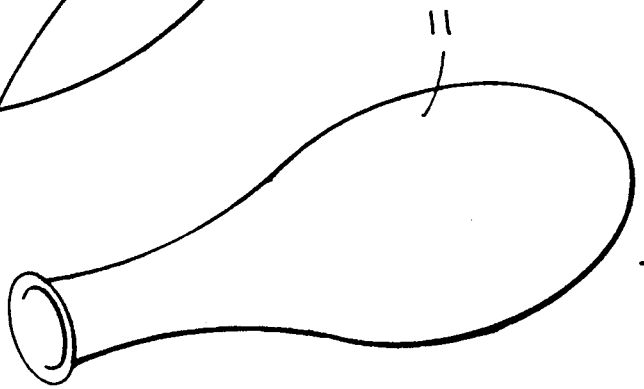
FIG. 2 shows an uninflated rubber balloon which functions as the inflatable bladder of the ball.
Figure 1:
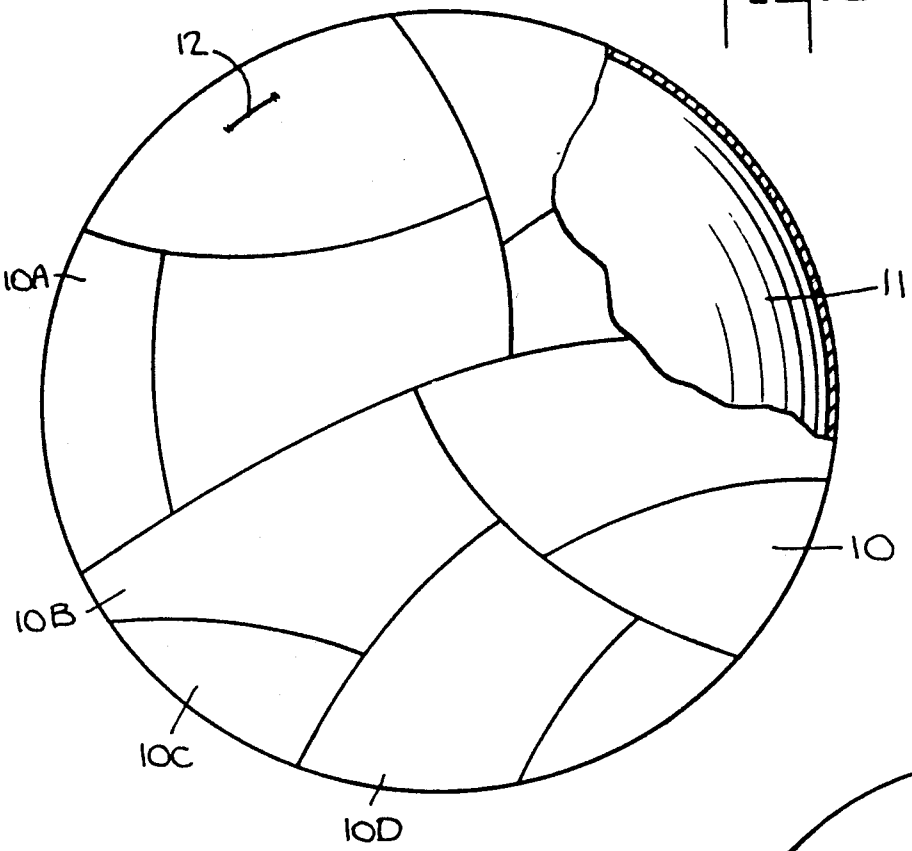
FIG. 1 illustrates, in perspective, a pneumatic ball of spherical shape in accordance with the invention.

Referring now to FIGS. 1 to 3, there is illustrated a spherical pneumatic play ball in accordance with the invention. The ball is constituted by an outer casing 10 and an inner bladder 1 which is inflated to conform to the spherical shape of the casing.

Casing 10 is created by interfitting pieces 10A, 10B, 10C, 10D, etc., of non-stretchable fabric sheeting sewn together by filamentary thread lines which are not visible on the outer surface of the casing. Alternatively, if the fabric is made of thermoplastic synthetic fibers, the pieces may be ultrasonically seamed together. A preferred fabric for this purpose is parachute cloth which is a high-strength, light-weight, closely-woven fabric made of synthetic fibers such as nylon. Other types of non-stretchable fabrics such as Gore-Tex may be used for the casing material.

Figure 4:
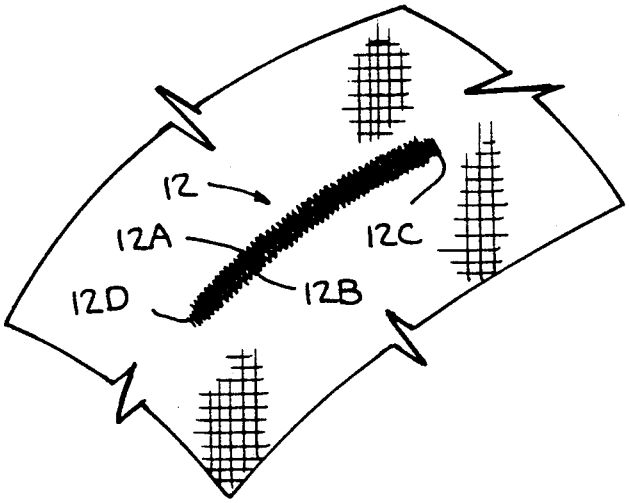
FIG. 4 is a separate view of the slit in the casing which when dilated functions as an open port.

Cut in one of the casing pieces is a slit 12. As shown separately in the enlarged view in FIG. 4, the borders 12A and 12B of slit 12 are reinforced by cotton, nylon, or other threading that is tightly coiled about the borders and terminates at reinforced points 12C and 12D at opposite end of the slit. In practice, the slit having reinforced borders can be made by using standard buttonhole machines for this purpose, for the slit in the fabric casing functions in a manner comparable to that of a buttonhole; that is, the slit is normally closed, but can be dilated to create an opening to admit a button, the slit then closing behind the button. The manner in which slit 12 functions both as an opening and as a closure in the context of a pneumatic ball will be explained later in greater detail.

Bladder 11 disposed within casing 10 is constituted by a conventional thin-skin rubber balloon having a long stem 13 which initially projects through slit 12 in the casing so that the balloon can be mouth-inflated with air.

An inflated rubber balloon is easily punctured and notoriously weak in other respects. Indeed, one of the pleasures of playing with balloons is to burst and explode them. As a balloon is being inflated, its rubber skin stretches and the skin which is thin to begin with becomes even thinner until a point is reached in the expanding diameter of the balloon where the skin is ruptured by the internal air pressure, at which point the balloon bursts.

When a rubber balloon, such as the balloon shown in FIG. 3, is inflated under conditions where the balloon is unconfined and free to expand, the balloon assumes a generally globular shape approaching a spherical form.

FIG. 2 shows balloon 11 expanded within the confines of spherical casing 10. The initial size of the balloon and the quality, thickness and density of its rubber skin are such that the expanded balloon within the casing is below its bursting point; that is, the point at which the skin is ruptured by internal pressure.

When in the course of its inflation the expanding balloon 11, which unconfined would assume a somewhat globular or tear drop form, engages and presses against the inner surface of the non-stretchable casing 10 which has an almost perfect spherical form, the balloon will then stretch differentially to conform its skin to that of the casing. In a ball having a spherical outer casing, relatively little differential stretching of the inner balloon occurs. But for casings having non-spherical shapes, such as a football shape, then a far greater degree of differential stretching of the skin of the balloon confined within the casing is necessary to conform the expanded balloon to the non-sperical form of the casing.

Figure 5:
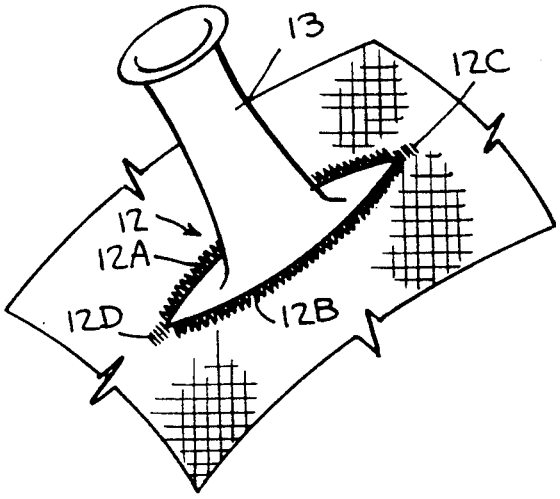
FIG. 5 illustrates the slit in its open port state with the neck of the balloon protruding therethrough.

Balloon 11 is mouth-inflated by air blown through its stem 13. When inserting the uninflated balloon into the casing through slit 12, it is then necessary, as shown in FIG. 5, to dilate slit 12 to create an open port to admit the uninflated balloon, stem 13 not going into the casing, but projecting out of the port.

Figure 6:
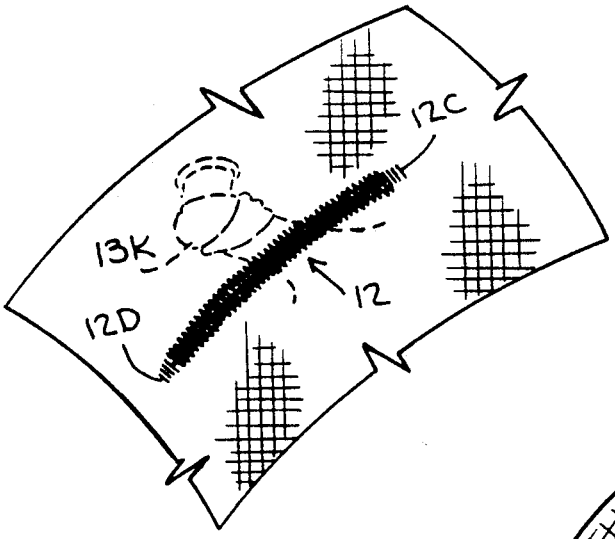
FIG. 6 shows the neck of the inflated balloon knotted and pushed below the slit in the casing.

After the balloon is fully inflated, then in order to seal the balloon to retain the pressurized air therein, one ties neck 13 into a knot. As shown in FIG. 6, the knotted neck 13K is pushed under casing slit 12, and now the neck is no longer within the slit. Casing slit 12 is under tension in that the casing is subjected to tension by the inflated rubber balloon which because of the high internal pressure seeks to expand but is prevented from doing so by the non-stretchable casing. By reason of this tension, slit 12 is then forced to recover its almost fully closed state, thereby encasing the balloon.

Thus the slit carries out two functions: one; it provides, when dilated, an opening through which an uninflated balloon may be inserted into the casing or from which a deflated balloon can be removed from the casing. Second, when closed, it effectively shuts this opening. In short, the slit carries out the same function as an opening and separate closure therefor as shown in the prior Spector patent.

In the case of an unconfined balloon, should one squeeze the balloon or subject it to pressure, then as the balloon is depressed in the region to which the pressure is applied, the resultant compression of the internal air will force the balloon skin to stretch in the unpressed regions thereof, and if the pressure is heavy, the balloon may burst. Thus, if an unconfined balloon is inflated to its maximum safe diameter, say, a one-foot diameter, and the balloon is squeezed to cause it to assume a figure-of-eight pattern, the resultant stretching of the rubber skin which takes place in the unpressured regions of the balloon may exceed the safe limit and cause the balloon to burst.

But in the present invention, the balloon bladder is confined by the non-stretchable fabric casing; and regardless of how the balloon is handled, the balloon is not permitted to expand within the confines of the casing beyond its maximum safe diameter. We have found that an encased balloon so encased has exceptional strength, far greater than that of an unconfined balloon or a balloon confined within a stretchable casing. Indeed, tests have shown that the ball, when subjected to hundreds of pounds of pressure, will not burst. Thus, if a heavy adult sits on the ball, it will sustain this load.

The embodiment of the play ball shown in FIG. 1 has the shape and external appearance of a spherical play ball, such as a soccer ball. In the case of a soccer ball, the outer casing is formed by pentagon-shaped, non-stretchable fabric pieces which are sewn or otherwise joined together. Some of these pieces are dyed black, while others are white, as in a standard athletic soccer ball. However, the diameter of the ball need not be as great as a standard soccer ball so that it can be handled more easily by a small child. But in other types of spherical play balls, the pieces may have other geometric forms printed in contrasting colors and decorative patterns.

Because the thin fabric casing is flexible and the balloon bladder is filled with compressible air, the fingers of a small child grasping the ball will press into and temporarily indent the ball to give the child a good grip on the ball. This gripping action is enhanced by the surface of the fabric which is somewhat rough as compared to smooth plastic. This physical characteristic of a ball in accordance with the invention makes it easy for a pre-school player to grasp, throw, bounce and catch the ball.

Figure 7:
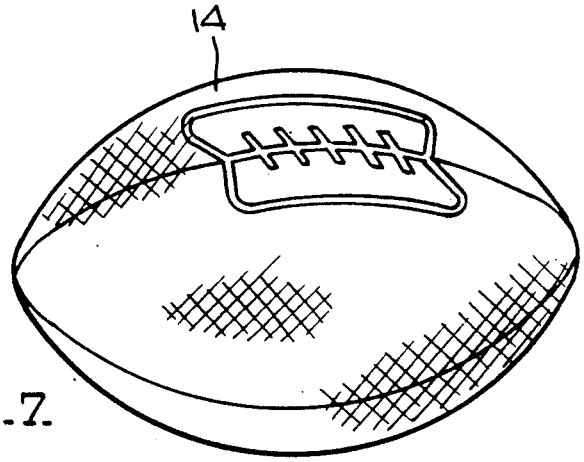
FIG. 7 shows a pneumatic ball in accordance with the invention in a football configuration.

In practice, a ball having a non-stretchable fabric casing and an inflatable balloon bladder in accordance with the invention may be made in any desired shape or given any desired appearance to resemble an actual athletic play ball of a particular type. Thus the football shaped ball shown in FIG. 7 has a football-shaped casing 14 of fabric which is printed to simulate the lacing of a standard football having a leather casing. Within this casing is a rubber balloon which when inflated stretches differentially to conform to the shape of the casing.

A fabric-encased balloon, while not nearly as heavy as a leather or a plastic-encased pneumatic ball, has sufficient weight to permit easy throwing without, however, inflicting injury should the ball hit a child. When the ball is spherical in form, its fabric casing may be provided with a circular colored band at the equator to create, when the ball is thrown, a saturn-ring or flying saucer effect, particularly if the remainder of the casing is white. And to give greater weight to the balloon, its fabric may be made wet. This is particularly useful when playing on a windy beach.

A significant advantage of a ball in accordance with the invention in which the bladder is an ordinary rubber balloon and the casing is non-stretchable as compared to a conventional beach ball which uses a non-stretchable inflatable plastic sphere, is that the former has a much higher internal air pressure than the latter and therefore considerably more bounce. The reason for this difference is that when blowing up a non-stretchable plastic ball, it takes little air pressure to do so, for the ball offers virtually no resistance to expansion until it is fully expanded. But with a rubber balloon, it takes much more air pressure to stretch the rubber from the original small form of the balloon to its fully stretched state.

Because a pneumatic play ball in accordance with the invention is likely to be subjected to hard play in which the ball is struck or is bounced vigorously against rough, hard surfaces, it is important that the outer casing be capable of withstanding such hard play. Hence in practice, the fabric pieces from which the casing is made are preferably of high-strength, abrasion-resistant material, and the filaments or threads used to seam the pieces together should also be of high strength, such as stretch-oriented nylon.

While there have been shown and described preferred embodiments of a pneumatic play ball in accordance with the invention, it will be appreciated that many changes and modifications may be made therein without, however, departing from the essential spirit thereof.

I claim:

1. A pneumatic play ball comprising:

(a) an outer casing formed of non-stretchable, flexible material which when the casing is expanded assumes a desired play ball configuration, said casing having a dilatable slit and a mouth inflatable balloon therein, said slit being normally undilated or closed with its borders closely adjacent each other, but said borders being separable to form a dilatable slit which is devoid of any closure means for securing said borders together to close said slit;

(b) said mouth-inflatable balloon having a rubber skin and a knottable air-passage stem projecting outward therefrom, the characteristics of said casing and slit being such that said balloon in its uninflated state may be admitted into said casing through an open port created by dilating or separating the borders of the slit, the stem then projecting out of the port so that the balloon can be mouth-inflated within the confines of the casing to a degree causing the skin to stretch to conform to and press against the inner surface of the casing to subject the casing to tension, after which the stem may be knotted to prevent the escape of air from the balloon and be pushed into said open port, whereby the slit then, as a result of casing tension, is allowed to recover its undilated, substantially closed state and no portion of the inflated balloon can be extruded from the casing when the ball bounces, the flexibility of said casing and balloon being such that when said balloon is filled with compressible air, subjecting said casing to tension, the fingers of a small child grasping the ball will temporarily indent the ball to give the child a good grip on the ball.

2. A ball as set forth in claim 1, wherein said casing is formed by interfitting pieces of fabric sheeting which are seamed together.

3. A ball as set forth in claim 2, wherein said slit is formed in one of said pieces.

4. A ball as set forth in claim 3, wherein said slit has borders which are reinforced by threading coiled about the borders.

5. A balloon as set forth in claim 1, wherein said ball casing is spherical and said balloon, when unconfined, assumes upon inflation a generally globular form, and when inflated within the confines of the spherical casing then assumes the same spherical form.

6. A ball as set forth in claim 1, wherein said ball casing has an elongated football shape and wherein said balloon, when unconfined, assumes upon inflation a generally globular form, and when inflated within the confines of the football-shaped casing assumes the same shape as said casing.

* * * * *